US009777924B2

(12) United States Patent
Bertelli

(10) Patent No.: US 9,777,924 B2
(45) Date of Patent: Oct. 3, 2017

(54) METHOD AND DEVICE FOR VERIFYING THE INTEGRITY OF GAS VALVE OPERATORS IN A GAS APPLIANCE

(71) Applicant: BERTELLI & PARTNERS S.R.L., Angiari (VR) (IT)

(72) Inventor: Pierluigi Bertelli, Legnago (IT)

(73) Assignee: BERTELLI & PARTNERS S.R.L., Angiari (VR) (IT)

( * ) Notice: Subject to any disclaimer, the term of this patent is extended or adjusted under 35 U.S.C. 154(b) by 0 days.

(21) Appl. No.: 14/386,143

(22) PCT Filed: Mar. 21, 2013

(86) PCT No.: PCT/IB2013/052236
§ 371 (c)(1),
(2) Date: Sep. 18, 2014

(87) PCT Pub. No.: WO2013/144789
PCT Pub. Date: Oct. 3, 2013

(65) Prior Publication Data

US 2015/0100275 A1 Apr. 9, 2015

(30) Foreign Application Priority Data

Mar. 26, 2012 (IT) ..... MI2012A0472

(51) Int. Cl.
*F23N 5/24* (2006.01)
*F23D 14/72* (2006.01)

(52) U.S. Cl.
CPC ..... *F23N 5/242* (2013.01); *F23N 5/245* (2013.01); *F23D 14/725* (2013.01);
(Continued)

(58) Field of Classification Search
CPC ..... F23N 2035/24; F23N 2025/06; F23N 2029/00; F23N 2031/10; F23N 2035/14;
(Continued)

(56) References Cited

U.S. PATENT DOCUMENTS 4,457,692 A * 7/1984 Erdman ..... 431/19
5,085,576 A * 2/1992 Bonne et al. ..... 431/22
(Continued)

FOREIGN PATENT DOCUMENTS

GB 2099158 A 12/1982
GB 2109127 A 5/1983
GB 2328499 A 2/1999

OTHER PUBLICATIONS

International Search Report and Written Opinion mailed Aug. 1, 2013 for PCT/IB2013/052236 to Bertelli & Partners S.R.L. filed Mar. 21, 2013.

*Primary Examiner* — Andrew Schechter
*Assistant Examiner* — Kyle R Quigley
(74) *Attorney, Agent, or Firm* — Vorys, Sater, Seymour and Pease LLP

(57) ABSTRACT

A method and device for verifying the integrity of each operator of a gas valve including two operators disposed in succession on a passage path for the gas directed to a burner; the operator being subjected to command action by a corresponding actuator controlled by a command and control unit adapted to sense the presence of the flame in the burner, which is correlated with the gas flow rate reaching this burner. Each operator is made to close alternately, with corresponding cessation of gas feed to the burner and successive sensing of the extinguishing of the flame at the burner within a predefined time period, power to these operators being completely interrupted if it is sensed after said time period that the flame is extinguished.

20 Claims, 2 Drawing Sheets

(52) U.S. Cl.
CPC *F23K 2900/05001* (2013.01); *F23N 2025/06* (2013.01); *F23N 2029/00* (2013.01); *F23N 2031/10* (2013.01); *F23N 2035/14* (2013.01); *F23N 2035/16* (2013.01); *F23N 2035/18* (2013.01)

(58) Field of Classification Search
CPC .. F23N 2035/16; F23N 2035/18; F23N 5/242; F23N 5/245; G01M 3/2876; F23D 14/725; F23K 2900/05001; F01L 13/0005; F01L 9/04; F02D 41/221
See application file for complete search history.

(56) References Cited

U.S. PATENT DOCUMENTS

| | | | | |
|---|---|---|---|---|
| 6,003,544 | A * | 12/1999 | Turrin | F23N 1/005 137/488 |
| 2010/0148755 | A1* | 6/2010 | Liu | 324/123 R |
| 2012/0212873 | A1* | 8/2012 | Davis | H01F 7/18 361/187 |
| 2013/0154841 | A1* | 6/2013 | Kucera et al. | 340/605 |

* cited by examiner

METHOD AND DEVICE FOR VERIFYING THE INTEGRITY OF GAS VALVE OPERATORS IN A GAS APPLIANCE

CROSS-REFERENCE TO RELATED APPLICATIONS

This is a §371 National Stage Application of International Application No. PCT/IB2013/052236 filed on 21 Mar. 2013, claiming the priority of Italian Patent Application No. MI2012A000472 filed on 26 Mar. 2012.

The present invention relates to a method and device for verifying the integrity of gas valve operators in a gas appliance.

The invention relates in particular to the case in which the gas appliance comprises two or more safety operators for one or more gas valves; it also evidently applies generally in the case in which a single operator is present for a corresponding valve or several operators for each gas valve.

Moreover the ensuing description of the invention applies to gas valves in which the force required to drive the operator is generated (and is applied to the valve operator) by electrically powered solenoids. Evidently, this application is given by way of non-binding example only; the invention can be applied to gas valves of any type (for example with stepping motors, comprising solenoid motor or the like).

The method of the invention is able to identify operating irregularities or drifting of the closure force of a gas valve operator, for the purpose of providing the application (i.e. the boiler) with a greater safety level (in the sense of safety against the risk of unburnt gas escape).

Before discussing the merits, it should be noted that the term "operator opening" signifies an action by which the gas operator, i.e. the interception member including the valve valving element, when subjected to the correct command current level, enables the gas to emerge by opening a passage path for this latter (in which the valve is positioned) connected to the burner.

The term "operator closure" signifies that stage in which the gas operator is subjected to a lower or zero value of command current to automatically close in known manner the aforestated gas passage path.

For necessary and sufficient regulatory requirements, gas valves for domestic and/or industrial gas burning appliances are known to be constructed with two operators which, independently of each other, are able to close the gas passage on which they are positioned in series, they hence constituting a redundancy for the purpose of covering the risk to user safety. In most gas applications, gas valve safety operators are commanded by a single voltage command which opens or closes the gas passage according to operational requirements. Currently, no verification is generally carried out on operators as they are considered safe under current regulations. However potential mechanical faults exist which could reduce or nullify the safety function of one or both the operators (with consequent continuous feed of unburnt gas to the burner) without the control systems being able to normally detect and monitor this situation.

Boilers and appliances are known in which the operators are commanded individually (only as ON-OFF) and tested for closure to detect their lack of operation. GB 2328499 describes a boiler operating in this manner. These solutions however are unable to put the appliance in a safe state when the operator has lost its safety function, so that only the other operator remains as protection against gas emergence.

However, there are no known operating methods, devices or techniques applied to the gas burning appliance sector for hot water and domestic water production able to detect drift or defects which influence operator closure force. In particular, there are non solutions validly able to halt appliance operation when the performance characteristics of the gas operator are degenerating, or rather when these characteristics are undergoing worsening with time, even though still ensuring integral operation (i.e. the capacity for reliable and complete intervention) with regard to safety (i.e. complete closure of the gas passage) during the use of the appliance.

In this respect the advantage of detecting and timely indication of the possible loss of the safety function of one of the two gas valve operators is evident and fundamental for the purposes of safety, even though not contemplated by current regulations, by enabling the user to provide for replacing the defective component while this is still able to close the gas passage, because of the presence of the integral second operator, before a potential fault in the second operator is able to completely inhibit the gas path towards the burner (with obvious drawbacks, including the risk of explosion of the environment in which the appliance is positioned and into which the gas would escape).

It is also evident that the fact of being able to determine whether one of the two operators is degrading, i.e. losing its capacity to completely close or intercept the gas passage (for example because of its ageing, tolerances, environmental influences) while the mechanical members provided for this closure still have their closure capacity (force), even though reduced, provides the application with a level of safety which is distinctly greater than that which it currently possesses (including within the spirit of the new regulations on the subject, e.g. EN13611).

An object of the present invention is to provide an improved method and device which ensure maximum safety and functionality to a gas burning boiler appliance for domestic and/or industrial use.

A particular object of the invention is to provide a method and device able to detect decay, i.e. a reduction in the performance of gas valve operators which, with the passage of time or because of defect could result in a complete valve malfunction, said detection enabling such valves to be replaced before they reach a malfunction point such as to endanger the safety of the environment or of the construction in which the gas appliance is housed.

Another object is to provide a method and device which are universal, of reliable implementation and use, and can hence be operated with valves having operators which are commanded electrically, motorized by a stepping motor, or commanded in another known method.

These and other objects which will be apparent to the expert of the art are attained by a method and device in accordance with the accompanying claims.

The present invention will be better understood from the following drawings, which are provided by way of non-limiting example and in which.

Figure 1:
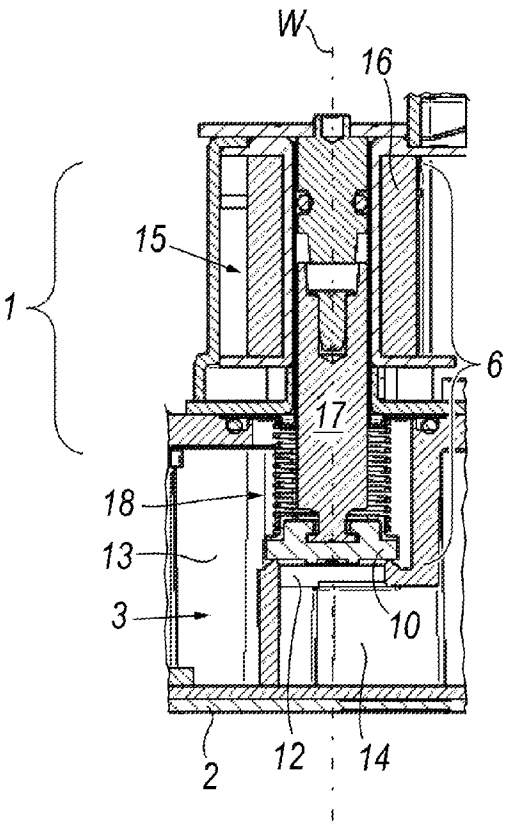
FIG. 1 shows a detail of a gas valve controlled by the method of the present invention.
Figure 3:
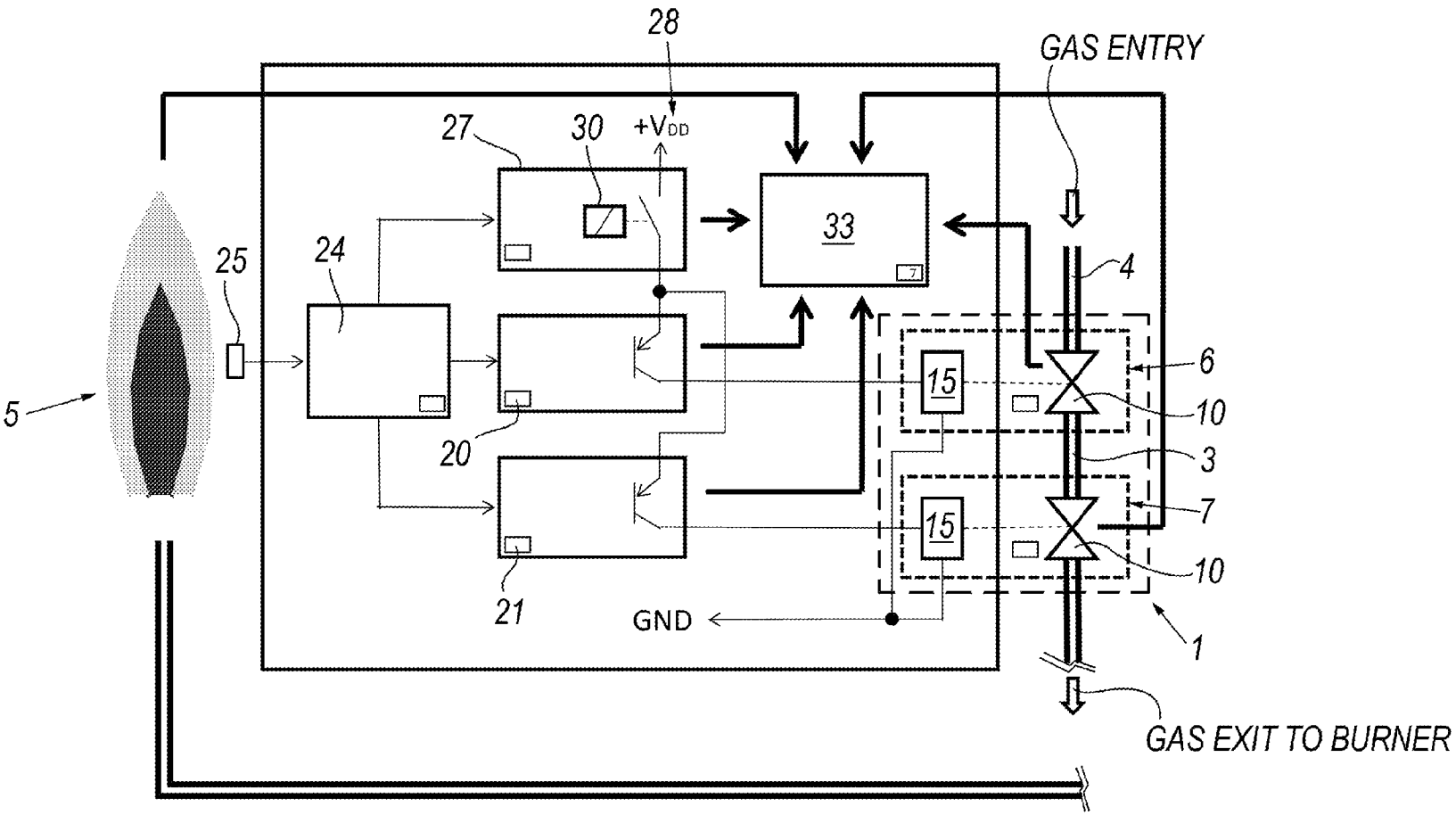
FIG. 3 shows a scheme of a device according to the invention.

With reference to said figures, a gas valve 1 is shown partially in FIG. 1 and comprises a body 2 in which a gas passage 3 is provided. This valve is positioned in a gas conduit 4 (see FIG. 3) and is arranged to enable or interrupt (or choke) the gas flow to a burner of a domestic and/or industrial appliance for heating water and for the production of domestic hot water. FIG. 3 shows a flame 5 which is generated at said burner (not shown).

Known operators 6 and 7 are provided along the conduit 4 to regulate or partially or completely interrupt gas flow through the passage 3 and hence through the conduit 4. These operators comprise, for example, a valving element 10 movable on an aperture 12 between two successive chambers 13 and 14 of said passage 3 and an actuator 15 for moving the valving element 10. This actuator can comprise a solenoid 16 acting on a mobile implement 17 carrying the valving element 10 at one end; when the solenoid is powered, this implement 17 can be moved along its longitudinal axis W against a spring 18 which tends to maintain the valving element closed on the aperture 12. When the solenoid is not powered, the valving element closes onto the aperture 12, forced by the spring.

Each operator 6 and 7 is commanded and controlled in its operation by a corresponding actuator 20, 21 connected to a command and control unit 24 for commanding and controlling the correct operation of the appliance or boiler. This is also achieved via a flame signal sensing device 25, of known type, positioned in proximity to the flame 5.

With the unit 24 a security switching member 27 (powered by mains 28) is associated, presenting a known switching element 30 (for example a relay or other member such as to apply to the operators the electricity quantity for actuation) controlled and commanded by the unit 24. The actuators 20 and 21 and hence the operators 6 and 7 (for example the solenoids 16 of this latter) are powered via the member 27. A diagnostic module 33 (for example controlled by a microcontroller or part thereof if an integral part of the unit 24) controls the correct operation of the operators 6 and 7 and is connected to the member 27, to the operators 6 and 7 of the valve 1 and to the actuators 20 and 21 connected to these latter. However, current regulations maintain that a third safety control element for the two gas operators is not necessary, therefore for example the safety member 27 could be omitted or not be present.

In particular, the actuator 20 is arranged to command an operator 6 preferably of ON-OFF type, whereas the actuator 21 is arranged to command an operator 7 preferably of modulating ON-OFF type. The operators can hence be mutually different: for example one operator could be commanded by a stepping motor or another operator could replace or be added to the solenoid-type operators 6 and 7. In that case the actuator 21, or an additional actuator, could consist of a known member for controlling the motor command waveform (frequency, steps and current).

Hence in the case of the illustrated valve 1 (but non-binding, given by way of example only):

- the operators 6 and 7 are commanded at low voltage,
- the command of the two series operators is separate, and
- two current regulators are present (associated with the actuators 20 and 21) to fulfil the command sequence.

Without detracting from the possibility of applying a variable (current or voltage) command to the operators, in known manner, it is evidently possible to also construct the valve 1 for, and to apply the control method of the invention to, operators functioning at different voltages (for example electric mains) and/or alternating voltages.

The method for controlling the functionality of the operators 6 and 7 consists of defining for each operator a closure sequence which manages to identify a drift, i.e. a fall, in the closure force (i.e. the capacity to completely intercept the aperture 12 on which the valve 10 operates) by utilizing:

- the operator command current as an indirect "measurement" of the closure force; and
- the flame as an indication of the gas flow rate to the burner.

This closure sequence takes place at a command current with an established value different from zero.

When the command current has been reduced to this value (by the action of the unit 24 alternately on each actuator 20 and 21), if the operator 6 or 7 is integral and free of faults which could prevent correct functionality, the gas passage 3 is closed completely, resulting in cessation of the flame signal sensed by the sensor 25. The control unit 24 senses the extinguishing of the burner within a predetermined time period (for example between 0 and 30 seconds, advantageously between 0 and 10 seconds, and typically less than 1 second), consequently considering the system to be integral and enabling its subsequent regular operation.

In the case of an operator 6 or 7 which is non-integral or is faulty (generically a "reduced closure force" on the valving element 10), a reduction of the command current to the established value does not result in closure or results only in partial closure of the gas passage 3 within the predetermined time. The control unit 24 detects the non-extinguishing of the burner flame (or alternatively only a partial decay) and goes into a safety condition (block stoppage), completely shutting off the command current to the actuators 20 and 21 to ensure closure of the operator 6 or 7.

The current value is defined by considering the limiting closure value, on reaching which the gas operator 6 or 7 is still able to fulfil its safety function with sufficient margin.

Simplifying, if the operator 6 or 7, when subjected to closure with this value, remains open, this is detected and the operator is set to safety; the residual closure force is in any event such as to ensure, once the command is removed (by removing electric power to the actuators 20 and 21), and with a margin, the complete tight closure of the closure member or valving element 10 (by virtue of the spring 18).

Consequently, by controlling the flame, the unit 24 determines whether by the closure generated by the appropriate intervention on the corresponding actuator 20, 21 the operator 6, 7 has been brought into the position for closing the relative aperture 12. If this has occurred and has occurred within the predetermined limiting time, the unit 24 determines whether the operator works effectively. Otherwise it commands immediate safety closure (and preferably generating a warning signal for the user).

The unit 24 is therefore able to determine what minimum action each actuator 20 and 21 has to carry out on the corresponding operator 6 and 7 to achieve closure of its relative aperture 12. This action can be expressed as a current value if the operator is a solenoid, or a particular action of an electric motor if the operator is driven by this latter (for example a predefined number of steps, or different current to the windings, for operating a stepping motor).

Figure 2:
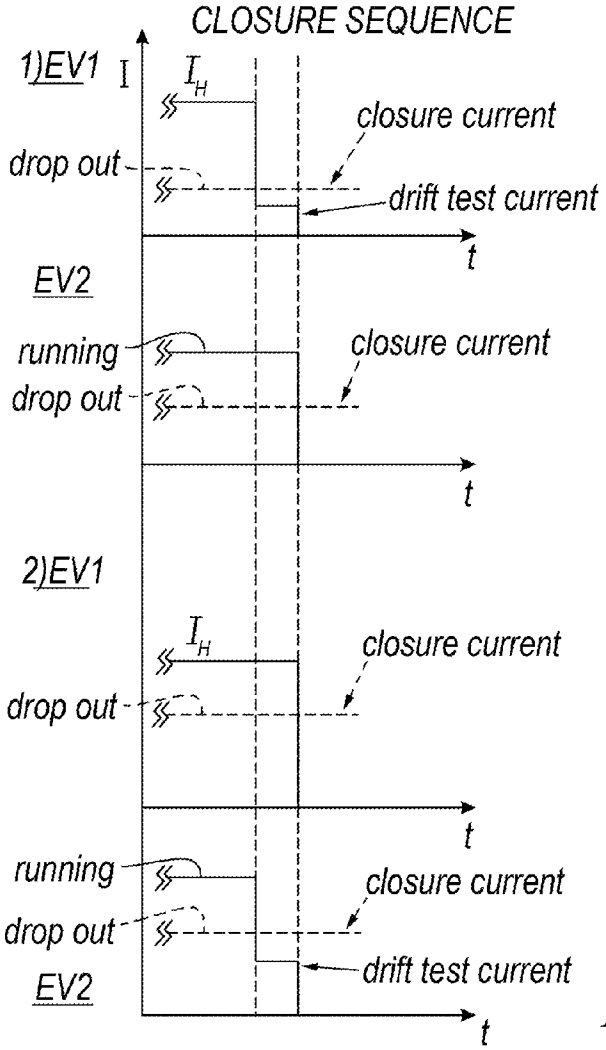
FIG. 2 is a graphic representation of the various stages of the method of the invention.

FIG. 2 shows the closure sequence of the two operators 6 and 7 of the valve 1. As can be seen from the sequence shown in FIG. 2, on closure, while one operator (for example that operator 6 indicated in FIG. 2 as EV2) is maintained open in the final working state, the command current is reduced to drift test current on the other operator 7, indicated as EV1 (subject of the "closure force test"). If the burner is extinguished within a predefined time (the flame 5 disappears as sensed by the sensor 25), the operator is integral; in the opposite case there has been a drift in the closure force and consequently a block stoppage is carried out, hence putting the system to safety.

This operation is alternatively carried out at each burner extinguishing request by the unit 24 in accordance with a predefined working programme (for example by means of an environmental thermostat) and/or at predefined time intervals (for example every predefined number of ignitions or a certain number of hours of operation) on both the operators 6 and 7, hence ensuring permanent monitoring of operator integrity, or by forcing periodic extinguishing in the case of systems permanently in operation.

The described method can be alternatively carried out not by instantly reducing the feed current (generated by the actuators 20 and 21) of the operators 6 and 7 to a predefined value but by reducing it gradually such as to measure the extinguishing current and evaluating its possible decay with time, to then carry out the aforedescribed necessary safety actions.

A particular embodiment of the invention has been described. Others are possible depending on the type of operators 6 and 7, for example by acting by means of a stepping motor or solenoid motor. In the case of a motor, for example, the value at which the functionality of the operator is investigated is a predefined number of rotation steps of the motor, or a certain value of the current to the windings at which the valving element is able to close the passage 3. These solutions are also to be considered as falling within the scope of the following claims.

The invention claimed is:

1. A method for verifying the integrity of each operator of a gas valve of a gas appliance, the gas valve comprising two said operators disposed in succession along a gas passage path through the gas valve configured for supplying gas to a burner in the gas appliance, the method comprising:

having each of said operators comprise:

a body accommodating a portion of the gas passage path, a movable valving member disposed within the body to close or open the respective portion of the gas passage path, and an electrically powered valving member actuator for operating the movable valving member to regulate closing or opening the respective portion of the gas passage path according to burner extinguishing requests, subjecting each of the valving member actuators to command action by a corresponding operator actuator, controlling each of the operator actuators in its turn by a command and control unit which supervises the gas appliance operation, wherein each operator actuator is electrically controlled, and controlling the electrical feed current to the operator actuator causes a minimum closure action of the respective gas passage path, the minimum closure action being defined by an electrical feed current different from zero but sufficient to cause closure of the respective gas passage path by the intervention of the respective operator, determining the electrical feed current sufficient to close the respective valve passage path portion by reducing the electrical feed current, starting from the electrical feed current which is able to maintain the operator in a position in which the operator does not choke the gas passage path, wherein the determination is performed at predetermined time intervals to evaluate if there has been decay in the electrical feed current sufficient to close the respective valve passage path portion, the command and control unit sensing a flame signal corresponding to the presence of the flame in the burner of the gas appliance proportional to the gas flow rate reaching the burner, each operator being made to close alternately, with corresponding cessation of gas feed to the burner and successive sensing of the extinguishing of the flame at the burner, detecting incorrect functionality of at least one of the operators whenever it is sensed that the flame is extinguished only at a time after a predefined limit has been exceeded, this indicating the incorrect functionality of the operator subjected to closure; and upon detecting the incorrect functionality of at least one of the operators, performing the additional step of permitting each of the operators to simultaneously close the gas passage to bring the gas passage into a safety position.

2. The method as claimed in claim 1, wherein the predefined limit is a time period between 0 and 30 seconds, wherein each operator actuator is a stepping motor or solenoid motor.

3. The method as claimed in claim 1, wherein electrical feed current sufficient to close the respective valve passage path portion is achieved by gradually reducing the electrical feed current, starting from the electrical feed current which is able to maintain the operator in a position in which the operator does not choke the gas passage path.

4. The method as claimed in claim 1, wherein each valving member actuator is an electric motor, a minimum closure action of the respective gas passage path portion being defined by a movement of the motor which enables the closure of the respective gas passage path of the gas valve to close within a predetermined time interval.

5. The method as claimed in claim 1, implemented at each burner extinguishing request.

6. The method as claimed in claim 1, implemented at predefined time intervals.

7. The method as claimed in claim 1, implemented after a predefined number of ignitions.

8. The method as claimed in claim 1, implemented by forcing the extinguishing of the burner if the burner is continuously in operation.

9. The method as claimed in claim 2, wherein the predefined time period is between 0 and 10 seconds.

10. The method as claimed in claim 9, wherein the predefined time period is between 0 and 3 seconds.

11. The method as claimed in claim 1, wherein the additional step comprises the step of performing a safety closure of each operator by permitting the corresponding operator actuator for each operator to completely close the respective gas passage path portion, wherein a safety closure of the gas passage path occurs.

12. The method of claim 1, wherein the gas appliance is a boiler.

13. The method of claim 1, wherein the gas appliance is a water heater.

14. The method as claimed in claim 1, wherein each valving member actuator is an electric solenoid, a minimum closure action of the respective gas passage path portion being defined by an electric current value to the solenoid which enables the closure of the respective gas passage path portion of the gas valve within a predetermined time interval.

15. The method as claimed in claim 1, wherein each valving member actuator is an electric motor, a minimum closure action of the respective gas passage path portion being defined by an electric current value to the electric motor which enables the closure of the respective gas passage path portion of the gas valve within a predetermined time interval.

16. The method according to claim 1, wherein each valving member actuator is a solenoid.

17. The method according to claim 16, wherein each operator actuator is a stepping motor or solenoid motor.

18. A method for verifying the integrity of each operator of a gas valve of a gas appliance, the gas valve comprising two said operators disposed in succession along a gas passage path through the gas valve configured for supplying gas to a burner in the gas appliance, the method comprising:

having each operator comprise:

a body accommodating a portion of the gas passage path, a movable valving member disposed within the body, and an electrically powered valving member actuator operating the movable valving member to regulate closing or opening the respective portion of the gas passage path according to burner extinguishing requests, subjecting each of the valving member actuators to command action by a corresponding operator actuator, adapting each of the operators to regulate closing or opening of the gas passage path according to burner extinguishing requests;

controlling electrical feed current from each of the operator actuators to each of the valving member actuators causing a minimum closure action of the gas passage path, the minimum closure action being defined by an electrical feed current different from zero but sufficient to cause closure of the gas passage by the intervention of the operator;

determining the electrical feed current sufficient to close the respective valve passage path portion by reducing the electrical feed current, starting from the electrical feed current which is able to maintain the operator in a position in which the operator does not choke the gas passage path, wherein the determination is performed at predetermined time intervals to evaluate if there has been decay in the electrical feed current sufficient to close the respective valve passage path portion, controlling each of the operator actuators in its turn by a command and control unit which supervises the gas appliance operation;

sensing a flame signal corresponding to the presence of the flame in a burner of the gas appliance proportional to the gas flow rate reaching the burner by the command and control unit;

alternating closing each operator with corresponding cessation of gas feed to the burner and successive sensing of the extinguishing of the flame at the burner;

interrupting the gas feed being detected due to incorrect functionality of at least one of the operators whenever it is sensed that the flame is extinguished only at a time after a predefined limit has been exceeded, this indicating the functionality of the operator subjected to closure is not completely correct; and performing the additional step of permitting each of the operators to simultaneously close the gas passage to bring the gas passage into a safety position upon detecting incorrect functionality of at least one of the operators.

19. The method according to claim 18, wherein each valving member actuator is a solenoid.

20. The method according to claim 19, wherein each operator actuator is a stepping motor or solenoid motor.

* * * * *